US005090734A

United States Patent [19]

Dyer et al.

[11] Patent Number: 5,090,734

[45] Date of Patent: Feb. 25, 1992

[54] METHOD FOR EFFECTING EVALUATION OF CONSUMER GOODS BY TEST PANEL MEMBERS

[75] Inventors: W. Richard Dyer, Roanoke; D. Dennis Heard, Plano, both of Tex.

[73] Assignee: Recot, Inc., Plano, Tex.

[21] Appl. No.: 560,925

[22] Filed: Jul. 31, 1990

[51] Int. Cl.[5] ..... B42D 15/00

[52] U.S. Cl. ..... 283/67; 434/365; 283/117

[58] Field of Search ..... 281/45; 283/36, 56, 283/58, 67, 117; 434/365, 363, 428, 430

[56] References Cited

U.S. PATENT DOCUMENTS

| | | | |
|---|---|---|---|
| 3,242,592 | 3/1966 | Weeks et al. | 281/45 X |
| 4,000,915 | 1/1977 | Strom | 283/36 X |
| 4,405,157 | 9/1983 | Bennett | 283/58 |
| 4,506,913 | 3/1985 | Kim | 283/56 |
| 4,817,990 | 4/1989 | Krest | 283/56 X |

*Primary Examiner*—Timothy V. Eley
*Assistant Examiner*—William Fridie, Jr.
*Attorney, Agent, or Firm*—Rothwell, Figg, Ernst & Kurz

[57] ABSTRACT

In a method for effecting evaluation of consumer products by test panel members, the panel members receive a set of test materials which include an evaluation set of products, a video tape containing a video presentation of members of the evaluation set and means for ordering products free of charge. The choices made by the panel members provide information as to preferences between test products and established brands. The evaluation process is repeated over several cycles to provide information regarding long term purchase habits and product sustainability.

20 Claims, No Drawings

METHOD FOR EFFECTING EVALUATION OF CONSUMER GOODS BY TEST PANEL MEMBERS

BACKGROUND OF THE INVENTION

1. Field of the Invention

The present invention relates to the field of product evaluation by consumers. More particularly, the invention provides a method for gauging consumer snack food product preferences among family members via a test method which parallels ordinary purchase-making decision processes.

2. Description of the Background Art

There are numerous methods known in the art for evaluating products, including food products, by members of the consuming public. These methods primarily gauge illicit behavior, namely, the instantaneous reaction to the test product, or preference of one product over another, as reported by the test panel member. One such type of evaluation is known as a "shopping mall survey," wherein shoppers are intercepted in a shopping mall or other appropriate location and asked if they are willing to participate in a survey. The willing respondents are first shown a picture of an advertisement of the product for which a survey is taken. After the respondent has examined the picture, respondent is asked questions relating to the product in the picture. The respondent may be asked to sample one or more products and report their reactions to the survey taker.

U.S. Pat. No. 4,506,913 discloses a procedure for conducting a survey by mail which substantially duplicates the results obtained in a shopping mall survey.

Other evaluation methods are disclosed in U.S. Pat. No. 4,405,157 relating to a survey data collecting system, U.S. Pat. No. 4,685,699 relating a multi-page promotional article including coupons, and U.S. Pat. No. 4,817,990 relating to a multiple value coupon system.

Another product evaluation procedure is the blind taste test. Participants sample one or more products without being told the brand identity thereof, and reactions and/or preferences are recorded.

U.S. Pat. No. 4,771,381 discloses a method for effecting sensory evaluation of a product by a sensory evaluation panelist. This method involves monitoring selected parameters of a sensory evaluation panelist, communicating a sequence of instructions and prompts to the panelist, coordinating the sequence of instructions and prompts to the sensory evaluation panelist and receiving a sensory evaluation rating from the panelist.

The prior art food product evaluation methods suffer from a variety of deficiencies. Notably, such procedures fail to provide a means for evaluating the subjects' preferences in comparison to many competitive products, as judged by consumption behavior. Thus, while a shopping mall survey or the like can provide information that at a given time a given number of cola drinkers prefer brand A over brand B, such a test method cannot judge product preferences among a large sample of competitive beverages and cannot track the longevity of and changes in such preferences. Survey-type tests usually are conducted in an environment quite foreign to the home environment, where many product preferences and purchase decisions are made. Such procedures fail to recognize the important impact of various family members on the purchase-making decision, as well as the impact of television advertising.

Another failing in the prior art test methods is their inability to track consumer preferences over a period of time. While the passer-by may exhibit a preference for one product over another, such initial or instantaneous preference says nothing regarding a product's "sustainability," i.e., it's ability to generate loyalty and hence repeat purchases among a segment of the consuming public.

Other failings of prior product evaluation methods include their inability to provide (1) meaningful baseline data concerning the product preferences and consumption history of the test panel members and (2) meaningful information regarding which family members make purchasing decisions so that product promotion can be effectively targeted.

Thus, there remains a need in the art for improved methods for effecting evaluation of consumer products by test panel members.

SUMMARY OF THE INVENTION

In accordance with the present invention, a method for effecting evaluation of consumer goods by test panel members comprises selecting a plurality of test panel members to receive a set of test materials from a source. An evaluation is conducted by providing each test panel member with the set of test materials over several cycles or "waves," so that product preferences and purchasing trends can be evaluated over time. In the context of snack food evaluation, the test materials comprise set of food products to be evaluated by the consumer (an "evaluation set"), a video tape containing a video presentation on each food product in the evaluation set, and means for ordering one or more food products (of the panel member's choosing) from the evaluation set. The evaluation set of food products may be comprised of a number of sub-sets; a set of experimental or test food products being evaluated (the "test set") and a set of currently-marketed commercial food products (the "market set") the test panel member will already be familiar with.

The product evaluation process is carried out in a plurality of cycles or "waves." In the first cycle ("base wave") the test panel receives information regarding and means for ordering products from an evaluation set comprised of only the market set. In subsequent waves, the test panel member receives information and means for ordering products from an evaluation set consisting of the union of the market set and the test set. Samples of test set products may be included among the test materials provided to the test panel member during these subsequent waves.

Each panel member is instructed to respond to the test by sampling the test food products and to utilize the ordering means to order a stated number of food products from the evaluation set. A panel member's food product preferences are evaluated by recording the identity of the food products ordered in response to each wave of the test. The products ordered during the base wave provide baseline data regarding the test panel members preferences. The products ordered during subsequent waves reflects the ability of the test products to "win over" the consumer and succeed in the competitive marketplace.

In preferred embodiments, the test panel members are families, and the test materials include means for recording the ordering preferences among family members.

In other preferred embodiments, the panel members are instructed to record their snack food purchases made outside of the test protocol. Preferably, this is carried out by instructing the test panel members to save empty snack food packages and send them to the test administrator for recordation.

DESCRIPTION OF THE PREFERRED EMBODIMENTS

The present invention provides a method for evaluating consumer goods, such as snack food products and the like, by test panel members in their home environment. The test panel members are permitted to "order," at no charge, a given number of snack food products within an evaluation set during each wave of the test. The panel members are free to order products from the evaluation set which includes both test products which are undergoing consumer testing and time-proven, high recognition market products. Test panel member opinion of new (test) snack food products versus the commercially-available products can be judged, based upon the ordering preferences.

A plurality of test panel members are selected to participate in the evaluation. The test panel members can be selected from various age groups and socioeconomic groups, as well as from various geographical and market areas, depending upon the types of products being evaluated. For the evaluation of snack food products, test panels wherein the panel members consist of families which are regular consumers of the types of snack food products being evaluated are particularly useful and preferred. Thus, for a snack food evaluation, it will be verified prior to beginning the evaluation that the selected family routinely purchases at least one bag of snack food product per week.

In the initial cycle or "base wave" of the product test evaluation method, the panel members receive a package of test materials which includes a video tape and printed materials and, optionally, samples of one or more of the products in the evaluation set. The video tape provides instructions describing the evaluation process to the test panel members, as well as a series of relatively short informational segments directed to each of the snack food products in the evaluation set. In preferred embodiments, these short video segments are about 10 seconds in duration and simulate television commercials. The test materials include a list containing the names of each of the products in the evaluation set, as well as means for the test panel members to order one or more of the food products in the evaluation set.

In preferred versions, the evaluation set employed in the base wave of the evaluation process contains solely market products which the test panel members will be substantially familiar with. Preferably current market leaders are included in the market set both in the base wave and in subsequent waves, with the content of the market set representative of current market leaders in the particular segment of consumer goods being evaluated. While the size of the evaluation set can be varied, a set consisting of about thirty to forty five individual products, representing about ten to twenty brands, often is preferred. A panel member's ordering preferences from among this initial list can be used to establish a baseline for that subject's snack food preferences. A written survey can be used to establish this baseline preference data as well as other baseline data, such as snack food consumption and purchase patterns. Thus, where the market set consists of a wide variety of savory snack food items, such as potato chips, corn chips, pretzels, etc., it is to be expected that any given individual will prefer one such type of snack food to another. The construction of baseline data will thus identify these preferences and will be useful in later interpretation of product selection data.

In order to permit the test panel members to evaluate one or more "test" snack food products, the evaluation set for subsequent waves of the evaluation process includes one or more of the test food products to be evaluated by the panel members. The test products comprising the test set and provided in each package of test materials may include, for example, various types, flavors and brands of potato chips, corn chips, tortilla chips, cheese puffs and the like, or combinations thereof. The test set preferably is comprised of from one to three test products.

The products comprising the test set can be selected in various manners. The test set can be selected on the basis of the baseline data elicited during the base wave, for example. The contents of the market set should be kept in mind when selecting the contents of the test set, so that the test set products can be compared to relevant market set counterpart products. Thus, where the test set includes an experimental pretzel product, for example, the market set also should include at least one pretzel product so as to provide a relevant basis for comparison. The fact that a pretzel eater chooses not to order an experimental pretzel product has a meaning vastly different than the fact that a non-pretzel eater makes the same decision.

The evaluation set in the subsequent waves usually will comprise both "test products," i.e. products undergoing consumer testing and not yet available on the market, as well as the "market products," i.e. established brands available on the market and possessing a reasonable degree of consumer recognition. In other versions of this evaluation process, however, market products can be tested against each other without introducing test products during subsequent evaluation waves.

In a particularly preferred embodiment, each test panel member receives sample food products (a "sample set") during each wave of the evaluation process. The sample set may include, for example, 1-3 food products from the evaluation set. Preferably, the set of sample products included each time in the test materials contains no more than one test product if an object of the study is the evaluation of the test product versus market products. The sample set accompanying the test materials for the base wave will preferably consist solely of market products.

In preferred versions, each product within the evaluation set as well as each test panel member is assigned an identifying code number, and the means for ordering products includes an automated telephone ordering system whereby test panel members enter their identifying code number and the code number(s) of the product(s) they have selected to order. In alternative versions of the evaluation process, a coupon-type ordering system can be employed.

The video tape which forms an important part of the test materials can begin with an introduction of the testing program and provide a general overview of the testing protocol. Additionally, a telephone number can be provided to enable the test panel members to receive further instructions for completing the test if the need arises. The video tape can also explain key points of the automated telephone ordering system or any other ordering system (such as a coupon order form) employed.

The video presentation spot for each food product can highlight important product points, for example ingredients and/or packaging features, and can reinforce or rely on features of prior or current product promotional campaigns. In preferred embodiments, the order of the product spots (video presentations) is randomized among the various tapes provided the test panel members, in order to minimize presentation order as a factor in product evaluation by the test panel members.

After a period of time subsequent to ordering products during the initial wave of the process, e.g. two weeks after initially sending out the packages of test materials, each responding panel member is provided with the food product(s) ordered by that particular panel member. The ordered products are accompanied by another package of test materials for evaluation by the test panel members. This package, and all subsequent packages, may contain one or more sample products in addition to the products ordered during the previous wave. As new test products are introduced into the test set, the list of products will be updated to include those test products in the evaluation set from which the test panel member may choose.

The test materials for the subsequent waves again include a video tape containing instructions and a video presentation on each food product in the evaluation set. Where test products are included in the evaluation set, the video presentations concerning them should parallel, as closely as possible, the presentations regarding the market products. The evaluation method can be carried on indefinitely by providing each test panel member with the previously ordered product(s) and a new package of test materials including new samples, a new video tape and means to order their choice of products.

The test panel member preferably is instructed to record snack food purchases made outside of the evaluation process during each wave. Such information is useful to provide a complete picture of the purchasing habits of the test panel member. In a preferred embodiment of the evaluation process, test panel members save empty packages of products consumed outside of the evaluation protocol. The empty packages are forwarded to the test administrator for recordation in the panel member's data file. In particularly preferred versions, the test panel member affixes an identifying barcode containing label to the empty package. The test administrator, using a hand-held bar code reader, scans both the bar code applied by the panel member and the Universal Product Code on the package. This provides a particularly convenient method of recording this data.

The present invention provides a unique method for effecting evaluation of consumer goods by test panel members. This method enhances the ability to predict successful products and concepts over previously known test methods. The present invention provides for accurate discrimination between strong and weak ideas in products, and provides a method for determining if a certain product can occupy a particular consumer niche. In particular, the method provides an indication of a test product's ability to displace a market product among the consuming public.

The present invention, by providing an evaluation set of products, from which the test panel member may order several at a time, simulates the shopping experience by providing the consumer with choices as to which product to "buy." With each cycle of the test, for example every two weeks, the test panel member has the freedom to include in their order a test product, which the panel member became aware of only through the evaluation, or solely market products of which the panel member was already aware. The fact that a panel member selects a test product thus provides information that the member prefers the test product to one or more of the commercial products.

If desired, other incentives or rewards may be provided to the test panel members. For example, supermarket coupons redeemable for free products may be included in the test materials. The identity of products for which such coupons are redeemed provides further information regarding the consumption behavior and preferences of the test panel member.

Although the invention has been described in connection with certain preferred embodiments and procedures, it is not so limited. The evaluation process may be used to evaluate a wide variety of consumer goods, with appropriate variation as will be readily apparent to those skilled in the field of consumer testing and evaluation. The present invention is particularly well suited to the evaluation of snack food products. Variations within the scope of the following claims will be employed both with snack food evaluation and with other products.

We claim:

1. A multi-wave method for effecting evaluation of consumer products by test panel members, comprising:

A) selecting a plurality of test panel members to receive a first set of test materials from a test administrator;

B) conducting a base wave by providing each test panel member with said first set of test materials, said first set of test materials comprising:

1) a base evaluation set of products, 2) a first video tape containing a video presentation on products in said base evaluation set, and 3) means for ordering at least one of the products in said base evaluation set;

C) instructing each panel member to respond to the base wave by utilizing the ordering means to order at least one of said products in said base evaluation set;

D) conducting a subsequent wave after conducting base wave (B) by providing each test panel member with a subsequent set of test materials, said subsequent set of test materials comprising:

1) a subsequent evaluation set of products;

2) a subsequent video tape containing a video presentation on each product in said subsequent evaluation set, and 3) means for ordering at least one of said food products in said subsequent evaluation set;

E) instructing each panel member to respond to the subsequent wave by utilizing the ordering means to order at least one of said food products in said subsequent evaluation set; and F) recording in a data file the identity of products ordered by each test panel member.

2. The method of claim 1 wherein the base evaluation set comprises a set of market products.

3. The method of claim 1 wherein the base evaluation set consists of a set of market products.

4. The method of claim 1 wherein the subsequent evaluation set comprises a set of market products.

5. The method of claim 1 wherein the subsequent evaluation set comprises a set of market products and a set of test products.

6. The method of claim 1 wherein the subsequent evaluation set comprises market products.

7. The method of claim 1 further comprising the step of providing at least one sample product to the test panel member during the base wave.

8. The method of claim 7 wherein the at least one sample product comprises a market product.

9. The method of claim 1 further comprising the step of providing at least one sample product to the test panel member during the subsequent wave.

10. The method of claim 9 wherein the at least one sample product comprises a market product.

11. The method of claim 9 wherein the at least one sample product comprises a test product.

12. The method of claim 1 wherein products in the evaluation set are designated by an identifying code and the ordering means comprises an automated telephone ordering system.

13. The method of claim 1 further comprising the step of providing each panel member with the food product ordered by that panel member from the evaluation set.

14. The method of claim 1 wherein the test panel members comprise families.

15. The method of claim 14 further comprising the step of recording product preferences of individual members of the families.

16. The method of claim 1 which comprises a base wave and five subsequent waves.

17. The method of claim 1 wherein the base evaluation set is comprised of about 30 to about 45 products.

18. The method of claim 1 wherein the subsequent evaluation set is comprised of about 1-3 test products.

19. The method of claim 1 further comprising the steps of collecting empty product packages from a test panel member and recording the identity of the package in the data file of the test panel member.

20. The method of claim 19 wherein the recording step is effected with a bar code reader.

* * * * *